United States Patent [19]

Gross

[11] Patent Number: 4,771,587

[45] Date of Patent: Sep. 20, 1988

[54] APPARATUS FOR STORING SHEET MATERIAL

[76] Inventor: Lester L. Gross, 6827 Humboldt Ave. South, Minneapolis, Minn. 55423

[21] Appl. No.: 373,433

[22] Filed: Apr. 30, 1982

[51] Int. Cl.[4] ..... B65B 67/04

[52] U.S. Cl. ..... 53/260; 53/390; 248/97

[58] Field of Search ..... 53/255, 260, 263, 390; 141/316, 390, 391; 248/97

[56] References Cited

U.S. PATENT DOCUMENTS

| | | | |
|---|---|---|---|
| 1,114,256 | 10/1914 | Gwinn | 141/316 X |
| 1,334,745 | 3/1920 | Farr | 53/260 X |
| 1,722,734 | 7/1929 | Coghzan | 53/260 |
| 1,981,881 | 11/1934 | Sumner | 53/260 |
| 2,987,863 | 6/1961 | Nowak, Jr. | 53/384 |
| 2,997,831 | 8/1961 | Neuendorf et al. | 53/86 |
| 3,186,667 | 6/1965 | Meuer | 248/97 |
| 3,585,781 | 6/1971 | Blee | 53/390 |
| 3,698,153 | 10/1972 | Lieberman | 53/260 |
| 3,722,561 | 3/1973 | O'Leary et al. | 141/316 |
| 3,737,129 | 6/1973 | Foster | 248/97 |
| 3,826,455 | 7/1974 | O'Donnell | 248/97 |
| 3,905,406 | 9/1975 | Cruse | 141/390 |
| 3,945,314 | 3/1976 | Hennells | 141/390 |
| 4,031,689 | 6/1977 | Sullivan | 53/370 |
| 4,037,778 | 7/1977 | Boyle | 141/390 |
| 4,062,170 | 12/1977 | Orem | 53/390 |
| 4,280,315 | 7/1981 | Von Hapsburg | 53/390 |
| 4,280,676 | 7/1981 | Betts | 141/390 |

*Primary Examiner*—John Sipos

*Attorney, Agent, or Firm*—Burd, Bartz & Gutenkauf

[57] ABSTRACT

Apparatus for and a method of inserting sheet materials, such as old newspapers, into paper bags, such as used grocery sacks, for storage, which includes a plurality of thin rigid dividers inserted into and repositionable in the sack so that material being inserted slides along the dividers, instead of along the insides of the sack. A separate base and tube may be used to support and strengthen the sack while the insertion is being accomplished.

24 Claims, 3 Drawing Sheets

Fig.1
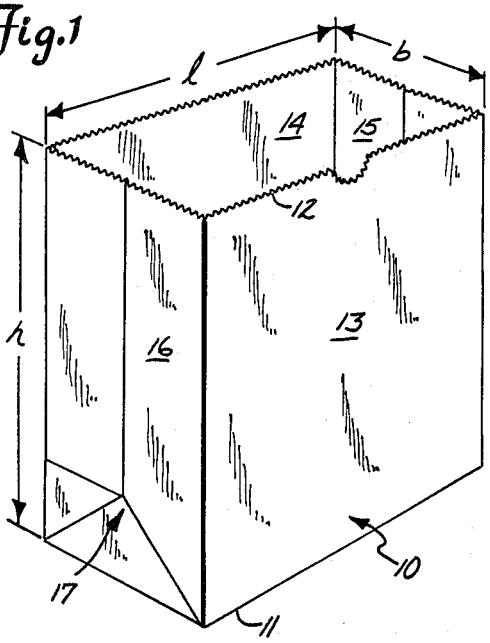
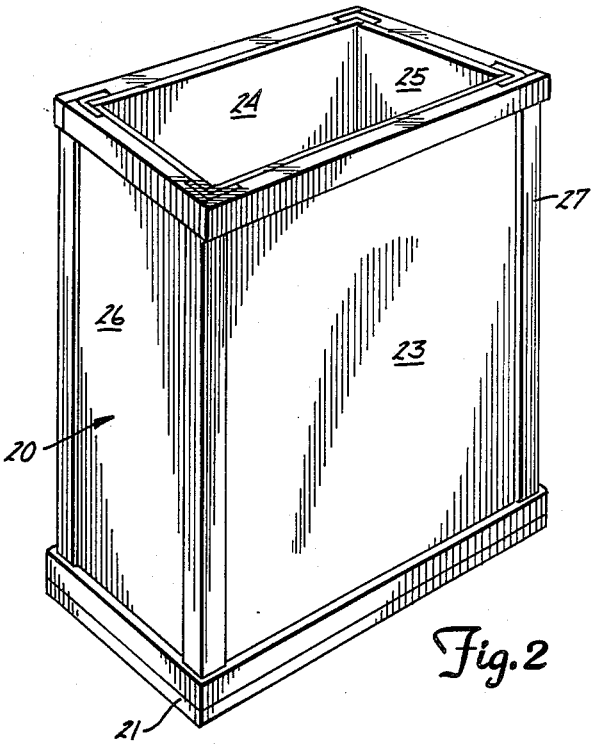
Fig.2
Fig.3
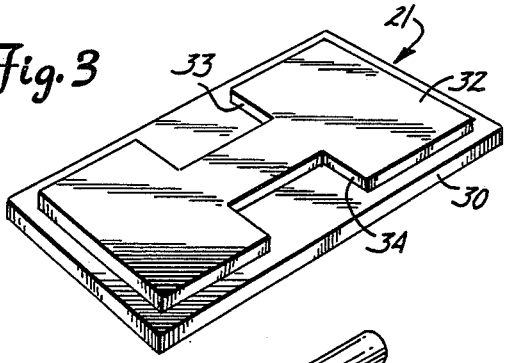
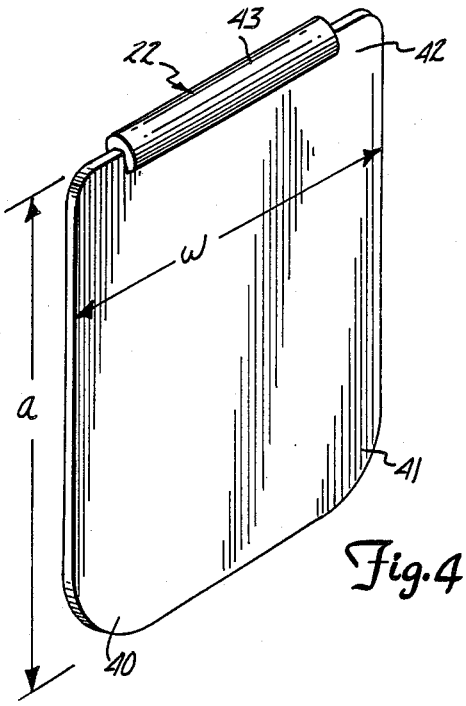
Fig.4
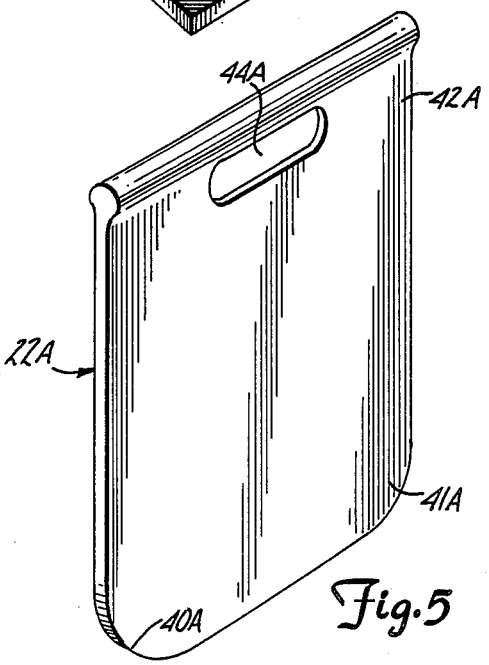
Fig.5

APPARATUS FOR STORING SHEET MATERIAL

TECHNICAL FIELD

This invention relates to apparatus for facilitating the storage of sheet materials, such as old newspapers. These materials accumulate in every household, and, while they have some value, they are troublesome to store and transport to a reclamation center. Traditionally, they are tied into bundles with cord, and the duty of repeatedly performing this task is often so undesirable that the materials are disposed of by burning, where this is permitted.

Another item that accumulates in most households is the large paper sack in which groceries are placed for delivery. It has been found that such sacks are of suitable size for receiving folded newspapers and other papers of the same size, but there has been no convenient way to fill such a sack with newspapers.

BRIEF SUMMARY OF THE INVENTION

The present invention comprises an apparatus and procedure whereby newspapers may be easily, conveniently, and compactly inserted into grocery sacks for storage and transportation.

The apparatus includes a plurality of dividers that are inserted into a sack to separate the sack chamber. Sheet material, as newspapers, are placed between adjacent dividers to fill the sack. A divider is removed from the sack and reinserted between adjacent dividers to provide a space for accommodating additional newspapers. The dividers aid in placing newspapers in compact side-by-side position in a sack.

The sack in one form of the invention is placed in a tube. The tube has side walls that hold the bag in its open position. The tube is removed from the sack after it is filled with newspapers.

The apparatus of the invention is a handy, low cost and hand operated structure that is used to pack newspapers in a conventional paper bag. These and additional advantages of the apparatus and method of the invention are embodied in the drawings and following detailed description.

BRIEF DESCRIPTION OF THE DRAWING

In the drawing, in which like reference numerals identify like parts throughout the several views, FIG. 1 shows a typical grocery sack, as used in the invention, FIGS. 2 and 3 show respectively a tube and a base for use in practice of the invention, FIGS. 4 and 5 show alternative embodiments of dividers used with the tube of FIG. 3.

DESCRIPTION OF THE PREFERRED EMBODIMENTS

Figure 6:
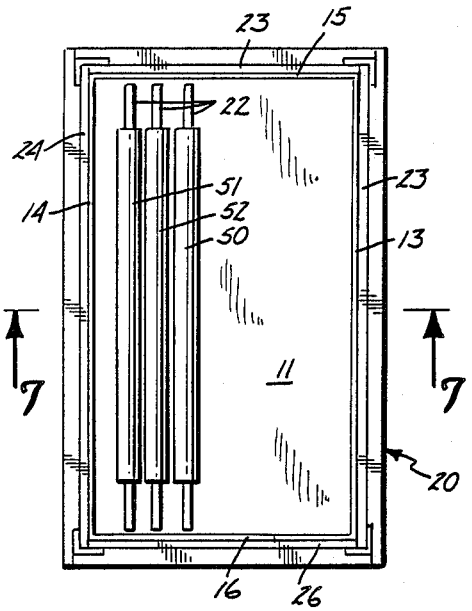
FIG. 6 is a plan view of the apparatus ready for use.

Referring to FIG. 1, there is shown a conventional grocery sack 10 useful in the invention to store sheet material, as newspapers. Sack 10 is generally rectangular bag having a closed bottom 11, an open top 12, wide side walls 13 and 14 and narrow end walls 15 and 16. End walls 15 and 16 include gussets 17 to enable the sack to be folded flat prior to use. Sack 10 is a paper bag identified as a 1/6 bag having a height of 17 inches, a width of 12 inches and a depth of 7 inches. Sacks having other dimensions can be used.

For storage of material in such a sack, my apparatus comprises a rectangular tube 20, a base 21, and a plurality of dividers 22. Tube 20 comprises front and rear walls 23 and 24 and side walls 25 and 26 assembled in a frame 27. The tube 22 is open at both its upper and lower ends. While shown as rigid, it may, if desired, be constructed with hinges to enable convenient flat storage. The inside dimensions of tube 20 are generally the same as the open dimensions of sack 10. Tube 20 is a rectangular wood housing having generally flat side walls 23 and 24 and end wall 25 and 26. Tube 20 can be tubular plastic.

Base 21 is conveniently composed of a first or bottom plate 30 having outside dimensions the same as those of the bottom end of tube 20, and a second plate 32 of overall dimensions the same as the inside dimensions of tube 20. Plate 32 has recesses 33 and 34 at sites mid-way along its longer edges, for a purpose presently to be described.

It will be evident that tube 20 can be placed on base 21, after which a sack 10 may be inserted and will be supported vertically and laterally by base 21 and tube 20.

Dividers 22 are of thin rigid material, such as wood or plastic. The width w is slightly less than the length l of a sack opening, and the length a is somewhat greater than the height h of a sack. Conveniently, the lower corners of the dividers are smoothly curved as at 40 and 41. A gripping member 43 is provided at the upper end 42 of each divider remote from corners 40 and 41. In FIG. 4, this gripping member is shown as an applied bead or molding 43.

Referring to FIG. 5, there is shown a modified divider 22A. Divider 22A is a rigid, flat member having a generally rectangular shape. The top edge of divider 22A has an enlarged bead 43A and a central opening 44 providing a hand grip for handling the divider.

Anyone who has had experience in attempting to store newspapers in paper sacks is aware of the inconvenience and frustration which accompany such an attempt. The procedure according to the present invention, which alleviates this frustration, will now be described in detail, referring to FIGS. 6–14, inclusive.

Figure 7:
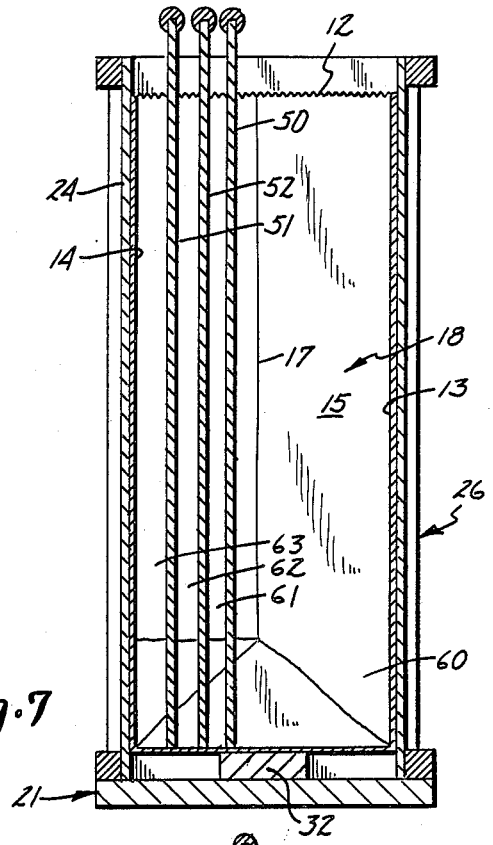
FIGS. 7–14 are views in vertical section, generally along the line 7—7 of FIG. 6, showing successive steps in the practice of the invention.
Figure 8:
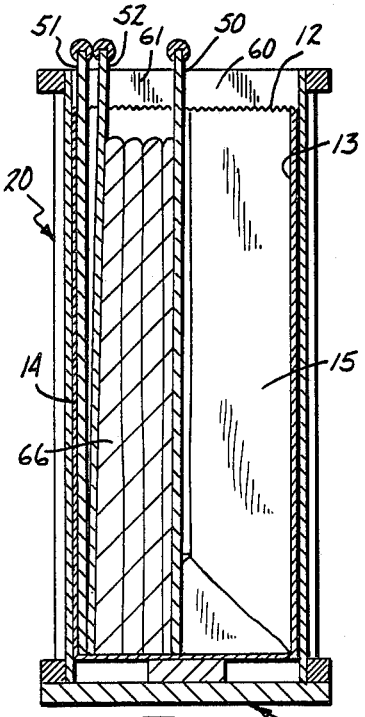
Figure 9:
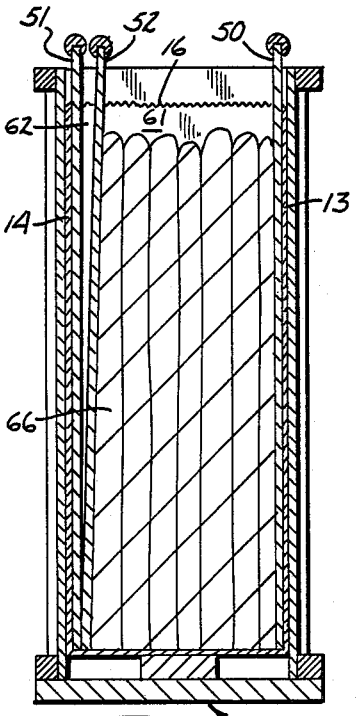

Base 21 is placed on a flat surface with plate 32 up. Tube 21 is placed on base 21 to fit around plate 32. A sack 10 is opened and inserted into tube 20 so that its bottom rests on base 21. Three dividers 22 are inserted into the sack 13. In plan, this arrangement is now in FIG. 6, and FIG. 7 shows this in condition in vertical section along the line 7—7 of FIG. 6. Alternatively, the tube 20 can be placed on a solid surface, such as the floor. The opened sack 13 is placed in the tube 20. The bottom of sack 13 rests on the floor with the walls of tube 20 surrounding the sack. For convenience of discussion, dividers 22 will be identified as first and second outer dividers 50 and 51 and a third or inner divider 52. Dividers 50, 51 and 52 separate the space in the sack into portions 60, 61, 62, and 63. The three dividers 50, 51, and 52 are positioned so that divider 51 is close to wall 14 of the sack 13 and divider 52 is close to it. Folded newspapers 66 and other sheet materials of the same general size are now slid down into the space 61 between dividers 50 and 52, as shown in FIG. 8. The sack 13 is held open transversely by the widths of the dividers 50, 51, and 52, and the newspapers 66 being inserted do not slide along either of the wide sack walls 13 and 14, but rather slide between dividers 50 and 52, which are rigid and smooth and do not wrinkle or crumple as the newspapers are inserted. Divider 50 moves toward wall 13 of sack 13 as the newspaper is added, space 60 becoming smaller and space 61 becoming larger, until divider 50 engages wall 13 of the sack, as shown in FIG. 9, space 60 disappears, and space 61 is loosely full of newspaper.

Figure 10:
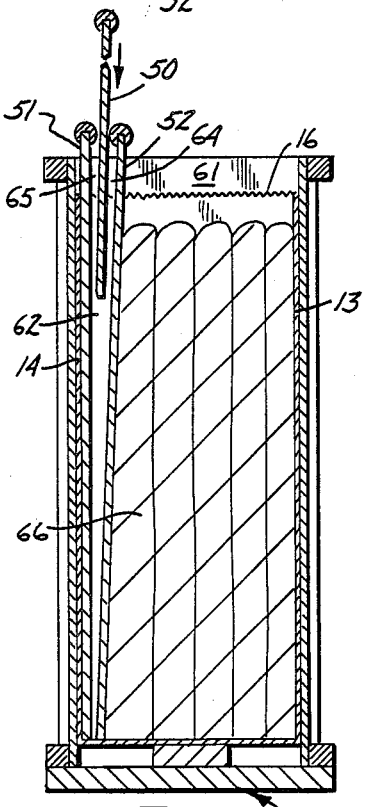
Figure 11:
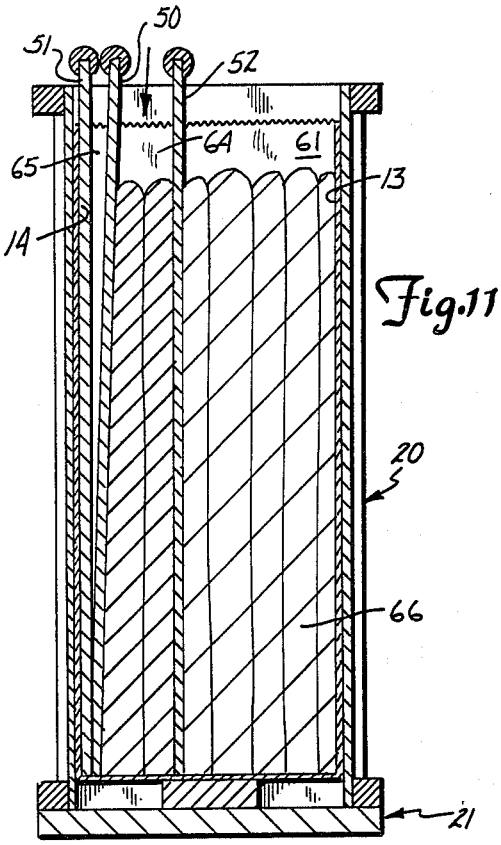

Next, divider 50 is drawn out of sack 10 and reinserted in space 62 between divider 51 and 52, dividing space 62 into sub-spaces 64 and 65, as shown in FIG. 10. The newspapers expand toward wall 13, but by jiggling divider 50 in its new position, divider 52 can be displaced toward wall 13 to again condense and compress the newspapers, and a few further papers can be added into the space 64 sliding between dividers 50 and 52, as shown in FIG. 11.

Referring to FIGS. 8 and 10, additional newspapers can be placed in sack 13 in the space 65 between dividers 50 and 51. Divider 51 is then withdrawn from the sack 13 and inserted between dividers 50 and 52. Newspapers are thus loaded into opposite sides of the sack 13 to balance the newspapers in the sack 13. The process of sequentially loading newspapers into the sack on opposite sides of the center divider insures tight packing of the papers in the sack. This is accomplished without tearing or separating the seams of the bag. Household newspapers accumulate daily. These newspapers can be placed in the sack 13 every day with the use of the dividers 50, 51, and 52 and the method of filling the sack with sheet material, as newspapers, of the invention.

Figure 12:
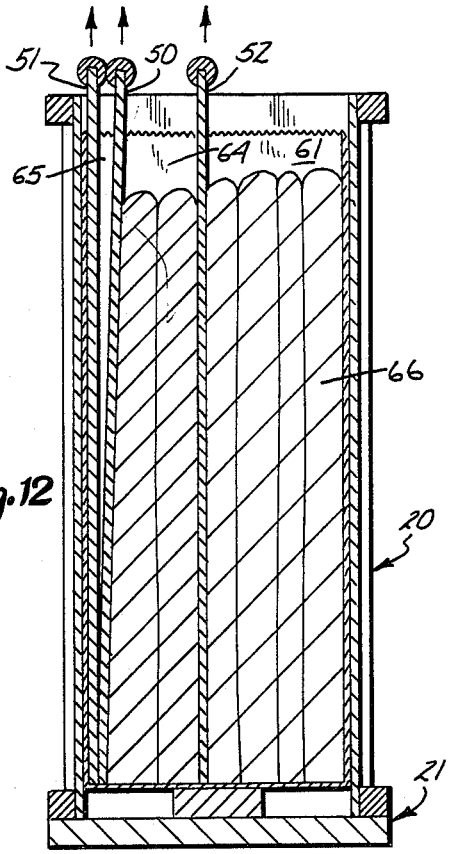
Figure 13:
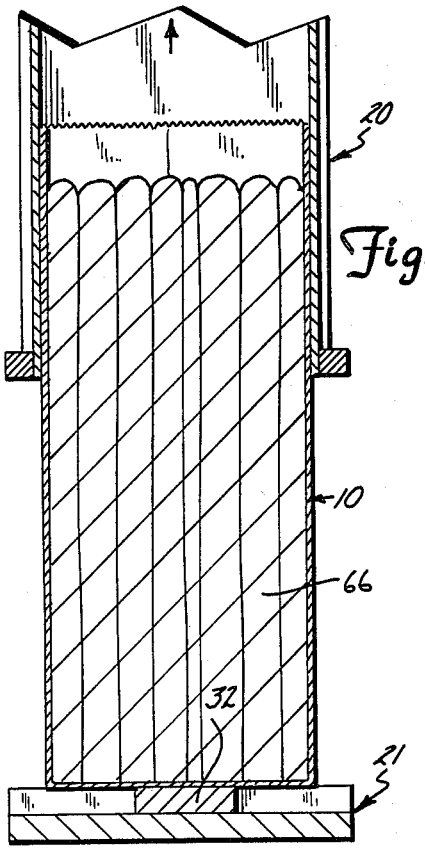
Figure 14:
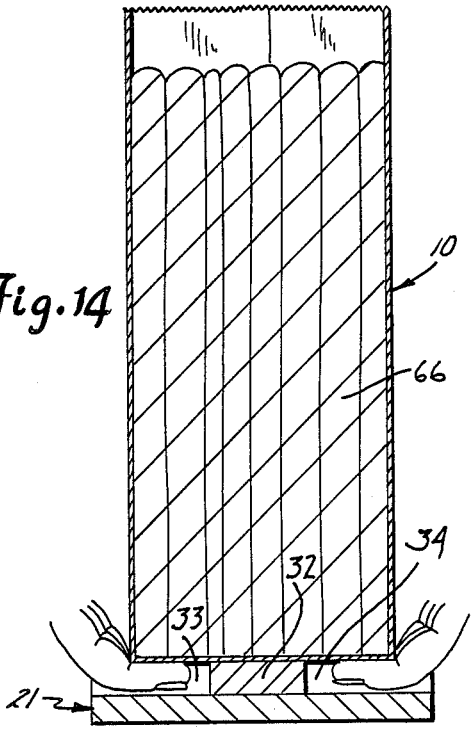

When the sack has been filled as full as is convenient, dividers 50, 51, and 52 are withdrawn, as suggested in FIG. 12, and the newspapers expand to fill the sack quite tightly, since the thicknesses of the dividers are relatively slight. Tube 20 may now be lifted off base 21, as shown in FIG. 13, leaving the loaded sack resting there. The user may now insert his fingers into recesses 33 and 34, as shown in FIG. 14, and lift the filled sack off the base 21 for tying, if desired, and the process is ready for repetition with a new sack.

It will be apparent that divider 51 functions only to protect the wall 14 of the sack when divider 50 is being repositioned on the other side of divider 52, and under some circumstances divider 51 may be omitted, greater care in moving divider 50 being exercised.

It will also be realized that while tube 20 and base 21 are helpful, by adding to the convenience of the apparatus, the plurality of dividers 50, 51, and 52 can function to practice the invention in filling a sack which is not so supported.

In our satisfactory embodiment of the invention the dividers 50, 51, and 52 and the walls of tube 20 were made of ⅛ inch wallboard. Other materials, as wood, plastic and the like can be used to make dividers 50, 51, and 52 and tube 20.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. An apparatus for filling with newspaper a generally rectangular open sack extending for a predetermined height from a closed end to an open end of predetermined length and breadth to accommodate newspaper comprising: divider means for facilitating the filling of a generally rectangular open sack with newspaper, said divider means comprising a plurality of generally flat rigid dividers of widths generally equal to said predetermined length and of length greater than said predetermined height of the open sack, each divider comprising a generally flat rigid member having a transverse linear lower end and convex curved lower corners, said dividers being adapted to fit into the sack through the open end thereof with the dividers being located side-by-side, each of said dividers being separately and selectively removable from said sack during the filling of newspapers into the sack.

2. The apparatus of claim 1 wherein: each divider has a hand gripping member extending along a first end thereof.

3. The apparatus of claim 1 wherein: each divider has an upper end, and a bead secured to said upper end.

4. The apparatus of claim 1 wherein: each divider has an upper end, and an opening in the upper end.

5. An apparatus for storing newspaper comprising: a hollow, generally rectangular tube of rigid material having inside dimensions generally the same as a generally rectangular open paper sack having a predetermined height from a closed end to an open end and a predetermined length and breadth, said tube having a height, length, and breadth substantially the same as said sack; and a plurality of generally flat rigid dividers insertable into an open sack contained in said tube through said open end of said sack, each divider comprising a generally flat rigid member having a transverse linear lower end, convex curved lower corners, and a length greater than said predetermined height and a width generally equal to said predetermined length, said dividers being separately and selectively removable from said sack during the filling of newspaper in the sack, said tube being removable from said paper sack filled with newspaper.

6. The apparatus of claim 1 including: a base configured to removably receive and support an end of the tube and the bottom of said sack when inserted in said tube.

7. The apparatus of claim 1 wherein: each divider has a grasping member extending along an end thereof.

8. The apparatus of claim 6 wherein: each divider has an upper end, and a bead secured to said upper end.

9. The apparatus of claim 6 wherein: each divider has an upper end, and an opening in the upper end.

10. Apparatus for storing generally flat sheet material in a generally rectangular open sack extending for a predetermined height from a closed end to an open end of predetermined length and breadth comprising: divider means for facilitating the filling of a generally rectangular open sack with sheet material, said divider means comprising a plurality of generally flat rigid dividers, each divider comprising a generally flat rigid member having a transverse linear lower end, convex curved lower corners, and a width generally equal to said predetermined length and of length greater than said predetermined height of the open sack, each of said dividers being adapted to fit into the sack through the open end thereof with the dividers being located side-by-side in said sack, each of said dividers being separately and selectively removable from said sack during a filling of the generally flat sheet material in the sack.

11. The apparatus of claim 10 wherein: each divider includes gripping means extending along a first end thereof.

12. The apparatus of claim 10 wherein: each divider has an upper end, and a bead secured to said upper end.

13. The apparatus of claim 1 wherein: each divider has an upper end, and an opening in the upper end.

14. An apparatus for storing generally flat sheet material in a generally rectangular open sack, said sack having a predetermined height from a closed end to an open end thereof and a predetermined length and breadth comprising:

a generally rectangular rigid tube having inside dimension generally the same as the length, breadth, and height of said sack, and a plurality of generally flat dividers insertable into an open sack contained in said tube through said open end thereof, each divider comprising a generally flat rigid member having a transverse linear lower end, convex curved lower corner, and a length greater than said predetermined height and a width generally equal to said predetermined length, said dividers being locatable in side-by-side positions within said sack and separately and selectively removable from said sack during the filling of the sheet material into the sack.

15. The apparatus of claim 14 including: a base configured to removably receive and support an end of the tube and the bottom of an open sack located within said tube.

16. The apparatus of claim 14 wherein: the tube has upright generally flat side walls and end walls, and an open top and bottom ends, said wall surrounding a space to accommodate said open sack.

17. The apparatus of claim 16 including: a generally flat base, said side walls and end walls being supported on said base.

18. The apparatus of claim 14 wherein: each divider has a grasping member extended along an end thereof.

19. The apparatus of claim 14 wherein: each divider has an upper end, and a transverse bead secured to said upper end.

20. The apparatus of claim 14 wherein: each divider has an upper end and an opening in said upper end.

21. The apparatus of claim 14 wherein: said plurality of dividers comprise three generally flat rigid members adapted to fit into the open sack, each of said members being selectively removable from said sack during the filling of the sheet material into the sack.

22. The apparatus of claim 5 wherein: the tube has upright generally flat side walls and end walls and open top and bottom ends, said walls surrounding a space to accommodate said open paper sack.

23. The apparatus of claim 22 including: a generally flat base, said side walls and end walls being supported on said base.

24. The apparatus of claim 5 wherein: said plurality of dividers comprise three generally flat rigid members adapted to fit into the open sack, each of said members being selectively removable from the sack during the filling of newspaper into the sack.

* * * * *